US007129435B2

(12) United States Patent
Sano

(10) Patent No.: US 7,129,435 B2
(45) Date of Patent: Oct. 31, 2006

(54) MOVABLE CONTACT ELEMENT AND PANEL SWITCH USING THE SAME

(75) Inventor: Yoshiro Sano, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/344,224

(22) Filed: Feb. 1, 2006

(65) Prior Publication Data

US 2006/0180455 A1 Aug. 17, 2006

(30) Foreign Application Priority Data

Feb. 2, 2005 (JP) ..... 2005-026065

(51) Int. Cl.
*H01H 1/10* (2006.01)

(52) U.S. Cl. ..... 200/512; 200/341; 345/170; 341/22

(58) Field of Classification Search ..... 200/5 A, 200/4, 512–516, 341–342; 345/168–172; 341/22–26

See application file for complete search history.

(56) References Cited

U.S. PATENT DOCUMENTS 4,933,522 A * 6/1990 Celander ..... 200/513
5,664,667 A * 9/1997 Kenmochi ..... 200/314
6,417,467 B1 * 7/2002 Yamagata ..... 200/5 A
6,593,537 B1 * 7/2003 Teruyama et al. ..... 200/515
6,683,265 B1 * 1/2004 Masuda ..... 200/406
6,824,448 B1 * 11/2004 Vines et al. ..... 451/36

FOREIGN PATENT DOCUMENTS

JP 10-188728 7/1998
JP 2002-216582 8/2002

* cited by examiner

*Primary Examiner*—K. Richard Lee
(74) *Attorney, Agent, or Firm*—Wenderoth, Lind & Ponack, L.L.P.

(57) ABSTRACT

Provided are a movable contact element used in a panel switch on the operation panel of various electronic devices and a panel switch using the movable contact element, which provide excellent operation feeling and simplify the production and integration processes. Between base sheet and the center of the outer surface of domed part of movable contact point is disposed spacer piece. Base sheet has a small protrusion swollen upward on its top surface, and the small protrusion serves as pressed part. This structure can eliminate the detachment of spacer piece from base sheet, and can also both simplify and improve reliability of the production and integration processes of the movable contact element and the panel switch. Providing pressed part ensures that the center of movable contact point is fully pressed down to a predetermined level, thus providing the user with excellent operation feeling.

3 Claims, 6 Drawing Sheets

MOVABLE CONTACT ELEMENT AND PANEL SWITCH USING THE SAME

FIELD OF THE INVENTION

The present invention relates to a movable contact element used in a panel switch on the operation panel of various electronic devices, and also to a panel switch using the movable contact element.

BACKGROUND OF THE INVENTION

In recent years, more and more portable electronic devices such as mobile phones and PDAs (Personal Digital Assistances) are having a panel switch using a movable contact element on the operation unit. A conventional movable contact element and a panel switch using it will be described as follows with reference to drawings.

FIG. 5 is a cross sectional view of the movable contact element, FIG. 6 is an exploded perspective view of the movable contact element, FIG. 7 is a view showing application of adhesive to the area of a base sheet that corresponds to a movable contact point as a component of the movable contact element, and FIG. 8 is a cross sectional view of the conventional panel switch using the movable contact element.

In FIG. 5, movable contact element 50 includes movable contact point 1. Movable contact point 1, which is made of an elastic metal thin film that is circular when seen from above, has a convexly domed top and an open bottom. Note that although FIG. 5 shows only one movable contact point 1 for convenience of explanation, typical touch panels have a large number of movable contact points 1. Each movable contact point 1 includes domed part 1A with throughhole 1B at its center.

Base sheet 2 is made of an insulating film such as PET (Polyethylene terephthalate). Each movable contact point 1 is in position with the outer surface of domed part 1A fixedly bonded to the bottom surface of base sheet 2 by adhesive 3 applied on the bottom surface of base sheet 2.

FIG. 6 is an exploded perspective view of movable contact element 50. Movable contact element 50 includes movable contact points 1 each having domed part 1A and throughhole 1B. As mentioned above, different portable electronic devices have different numbers of movable contact points 1. Movable contact element 50 includes base sheet 2 and adhesive 3 having peripheral part 3B.

FIG. 7 shows the positional relationship between base sheet 2 and adhesive 3 applied on base sheet 2 in order to fix movable contact point 1. The area with adhesive 3 thereon is shaded for clarity.

As shown in FIG. 7, adhesive 3 for fixing movable contact point 1 is applied in the shapes of circular ring part 3A and peripheral part 3B surrounding it, which are separate from each other. In other words, peripheral part 3B is formed outside circular ring part 3A with a prescribed spacing therebetween. Peripheral parts 3B are formed nearly on the entire bottom surface of base sheet 2.

FIG. 8 is a cross sectional view of the panel switch using the conventional movable contact element. Conventional panel switch 80 shown in FIG. 8 has movable contact element 50 shown in FIG. 5 including movable contact point 1, base sheet 2 and adhesive 3.

Panel switch 80 further includes fixed contact point 4 having a pair of outer fixed contact point 4A and central fixed contact point 4B. Fixed contact point 4 is formed on one main surface 5*a* of wiring board 5.

Movable contact point 1 and fixed contact point 4 are arranged in a predetermined positional relationship.

More specifically, circumferential bottom edge 1C of movable contact point 1 is placed on outer fixed contact point 4A in such a manner that throughhole 1B formed in the center of domed part 1A is substantially vertically aligned with the center of central fixed contact point 4B. Outer fixed contact point 4A and the bottom surface of base sheet 2 are fixedly bonded to each other by peripheral part 3B of adhesive 3.

Outer fixed contact point 4A becomes electrically continuous with the corresponding movable contact point 1, and the inner surface of domed part 1A of movable contact point 1 is opposed to the corresponding central fixed contact point 4B with a prescribed spacing therebetween.

This structure allows movable contact points 1 formed under the bottom surface of base sheet 2 to form single switches, thereby making up a panel switch as a whole. Above base sheet 2 are formed manual operation buttons 6 made of, e.g. rubber via which any of movable contact points 1 can be pressed.

In movable contact element 50 mentioned above, the bottom surface of base sheet 2 is generally covered with a protection sheet made of, e.g. an insulating film in order to protect movable contact points 1 and adhesives 3 from dust and the like during transportation and storage. The protection sheet is removed before base sheet 2 is bonded to wiring board 5.

Each single switch of the panel switch operates as follows. When the user presses manual operation button 6 of an electronic device, domed part 1A of movable contact point 1 below manual operation button 6 is pressed downward via base sheet 2. Then, domed part 1A is turned upside down with a sense of moderation, and the inner surface of domed part 1A comes into contact with central fixed contact point 4B. As a result, outer fixed contact point 4A and central fixed contact point 4B become electrically continuous with each other. Throughhole 1B of movable contact point 1 is pressed locally at its end against central fixed contact point 4B, thus enabling the switch to be in a stable ON state.

When the user releases the pressing force, the inner surface of domed part 1A leaves central fixed contact point 4B so as to restore domed part 1A to the original convex shape with a sense of moderation, thereby pushing back manual operation button 6 upward. As a result, the switch returns to the OFF state as shown in FIG. 8 in which outer fixed contact point 4A and central fixed contact point 4B are electrically independent of each other.

Prior art documents related to the invention of this application include Japanese Patent Unexamined Publications No.H10-188728 and No.2002-216582.

In these conventional movable contact elements and panel switch using them, for the user to have excellent operation feeling in a single switch, it is necessary to press the center of domed part 1A of movable contact point 1 by pressing manual operation button 6 formed on the electronic device side. However, when the panel switch is integrated into various electronic devices, variation in production processes and workability causes a slight misalignment between manual operation button 6 and the center of movable contact point 1. As a result, the electronic devices fail to provide the user with a predetermined level of operation feeling.

FIG. 9 shows another conventional panel switch to overcome these conventional problems. This panel switch is provided with pressing lug 8 which is fixedly bonded to the top surface of base sheet 2 in the center of domed part 1A of movable contact point 1. Providing pressing lug 8 enables pressing the center of movable contact point 1, even if manual operation button 6 is misaligned from the center of movable contact point 1 during production or integration process.

This structure provides the user with comparatively excellent operation feeling; however, fixedly bonding pressing lug 8 in a stable manner to base sheet 2 requires high-precision control of positioning pressing lug 8 during production and integration processes.

SUMMARY OF THE INVENTION

The present invention has overcome these conventional problems. When a movable contact point is integrated into a movable contact element, or a movable contact element is integrated into a touch panel, even if there is a slight misalignment between manual operation buttons, it is still possible to maintain excellent operation feeling on the touch panel and also to simplify the integration process, thereby achieving a reliable movable contact element and a panel switch using it.

The movable contact element of the present invention includes a base sheet made of an insulating film and having adhesive applied on its bottom surface. The movable contact element further includes a movable contact point made of an elastic metal plate and having a domed part with an open bottom. The domed part is fixedly bonded at its outer surface to the base sheet by the adhesive applied on the bottom surface of the base sheet. The movable contact element further includes a spacer piece which is sandwiched between the bottom surface of the base sheet and the center of the outer surface of the domed part of the movable contact point. The portion of the base sheet having the spacer piece thereunder forms a small protrusion, which functions as a pressed part of the movable contact point.

This structure can eliminate the detachment of the spacer piece from the base sheet, and can also control variation in production and integration processes. Furthermore, when the movable contact element is integrated into an electronic device to form a panel switch, even if there is a slight misalignment between the center of the movable contact point and the corresponding manual operation button, the manual operation button never fails to press the pressed part of the movable contact point that is formed as the small protrusion. This structure provides the user with excellent operation feeling.

Another movable contact element of the present invention includes a movable contact point having a throughhole at the center of the domed part. The top surface of the spacer piece is fixedly bonded to the bottom surface of the base sheet by the adhesive applied on the bottom surface of the base sheet, and the bottom surface of the spacer piece is placed on the outer surface of the domed part of the movable contact point. Since the movable contact point and the spacer piece are not fixed to each other, the movable contact point in operation is not affected by the spacer piece. Furthermore, the throughhole allows air to be moved in and out of the movable contact point. This prevents the operation feeling from being degraded due to air compression or the like, thereby providing the user with excellent operation feeling.

The panel switch of the present invention uses the movable contact element of the present invention. The panel switch includes a fixed contact point consisting of a pair of an outer fixed contact point and a central fixed contact point which are formed on a main surface of the wiring board. The movable contact point as a component of the movable contact element is positioned so as to place the circumferential bottom edge of the movable contact point on a predetermined position of the outer fixed contact point. The movable contact element is then fixedly bonded to the wiring board by the adhesive applied on the bottom surface of the base sheet.

This movable contact element never causes the detachment of the pressed part of the movable contact point, so that excellent operation feeling can be maintained for a long time.

As described hereinbefore, in the present invention, the spacer piece is sandwiched between the base sheet and the domed part of the movable contact point, and the portion of the base sheet having the spacer piece thereunder is swollen upward, i.e., toward manual operation button 6 so as to form the small protrusion, which functions as the pressed part of the movable contact point. This structure can simplify the production and integration processes of the movable contact element and the touch panel. Furthermore, when integrated into an electronic device, the movable contact element and the panel switch can provide the user with excellent operation feeling for a long time.

DETAILED DESCRIPTION OF THE INVENTION

An embodiment of the present invention will be described as follows, with reference to FIGS. 1 to 4.

Embodiment

Figure 1:
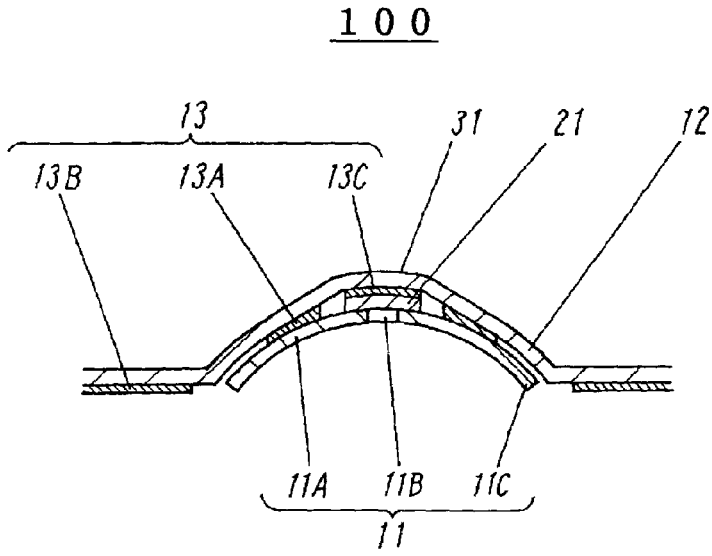
FIG. 1 is a cross sectional view of a movable contact element of an embodiment of the present invention.

FIG. 1 is a cross sectional view of a movable contact element of the embodiment of the present invention. Movable contact element 100 shown in FIG. 1 includes movable contact point 11 made of an elastic metal thin film. Movable contact point 11 is circular when seen from above, and has a convexly domed top and an open bottom. Domed part 11A of movable contact point 11 has circular throughhole 11B at its center, and circumferential bottom edge 11C at its end.

Base sheet 12 is made of an insulating film such as PET, and has adhesive 13 applied by, e.g. printing it on its bottom surface. Adhesive 13 is applied in the shapes of circular ring part 13A, peripheral part 13B and small-diameter circular part 13C. Movable contact point 11 is positioned in such a manner that the center of throughhole 11B is vertically aligned with the center of circular ring part 13A. Domed part 11A is fixedly bonded at its outer surface to base sheet 12 by circular ring part 13A of adhesive 13 applied on the bottom surface of base sheet 12.

Figure 2:
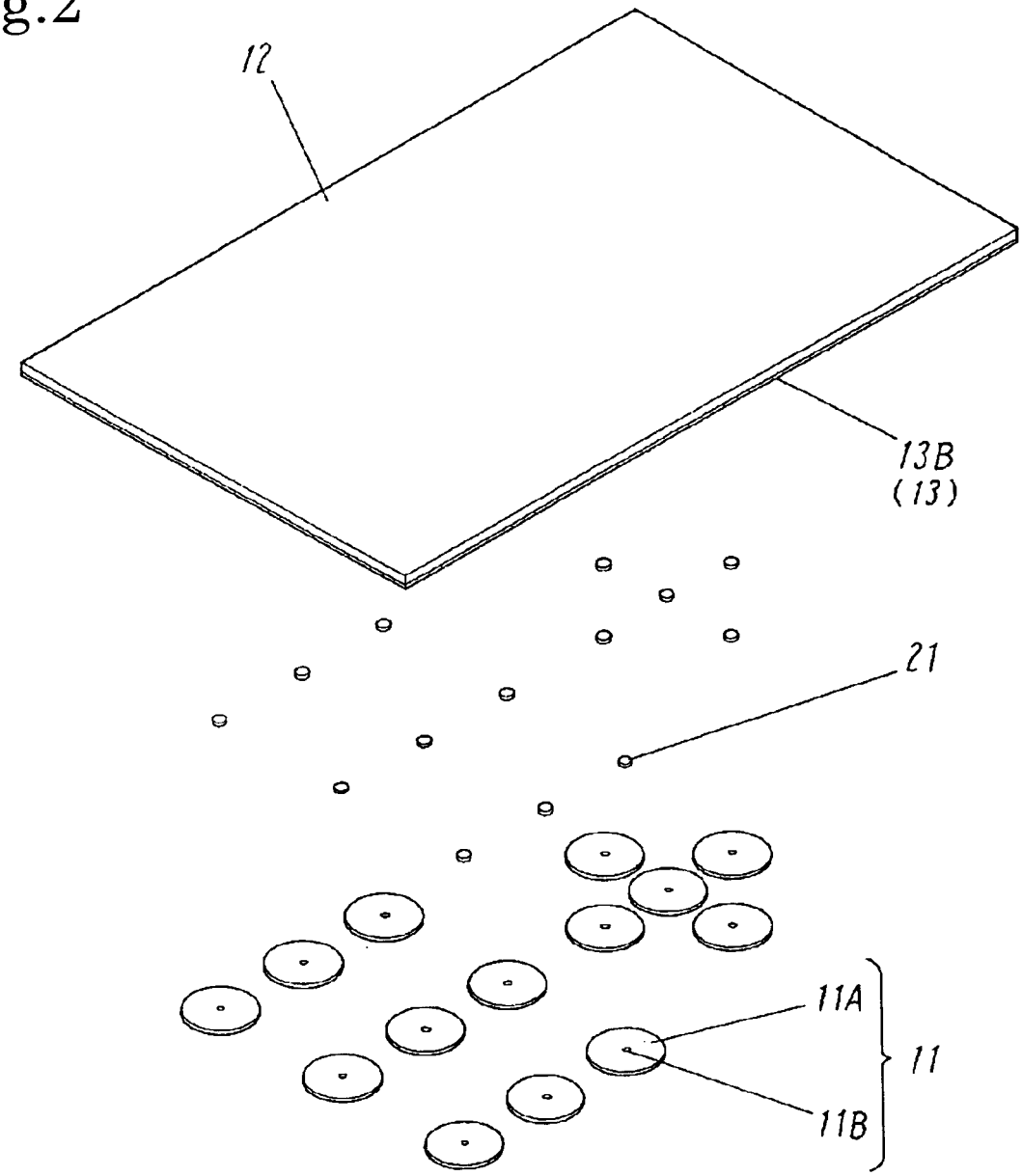
FIG. 2 is an exploded perspective view of the movable contact element of the embodiment of the present invention.

FIG. 2 is an exploded perspective view of movable contact element 100 shown in FIG. 1, which includes movable contact points 11, base sheet 12, adhesives 13 having peripheral parts 13B, and spacer pieces 21. Movable contact points 11 each include domed part 11A and throughhole 11B. Adhesives 13 each include peripheral part 13B. Movable contact points 11 can be arranged according to the type of electronic device using them. The schematic arrangement shown in FIG. 2 is designed for a mobile phone.

Figure 3:
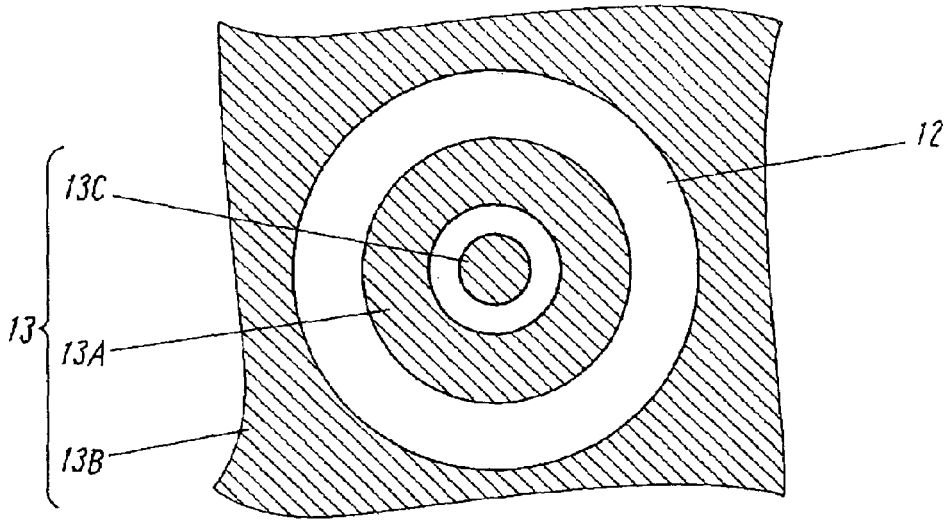
FIG. 3 is an enlarged view showing application of adhesive to the area of a base sheet that corresponds to a movable contact point, which is a main part of the movable contact element of the embodiment of the present invention.

FIG. 3 shows application of adhesive 13 to the area of base sheet 12 that corresponds to movable contact point 11. The area with adhesive 13 thereon is shaded. Adhesive 13 is applied in the shapes of circular ring part 13A, small-diameter circular part 13C formed at the center of circular ring part 13A and peripheral part 13B. Peripheral part 13B is outside circular ring part 13A with a prescribed spacing therebetween. Peripheral parts 13B are formed nearly on the entire bottom surface of base sheet 12.

Figure 4:
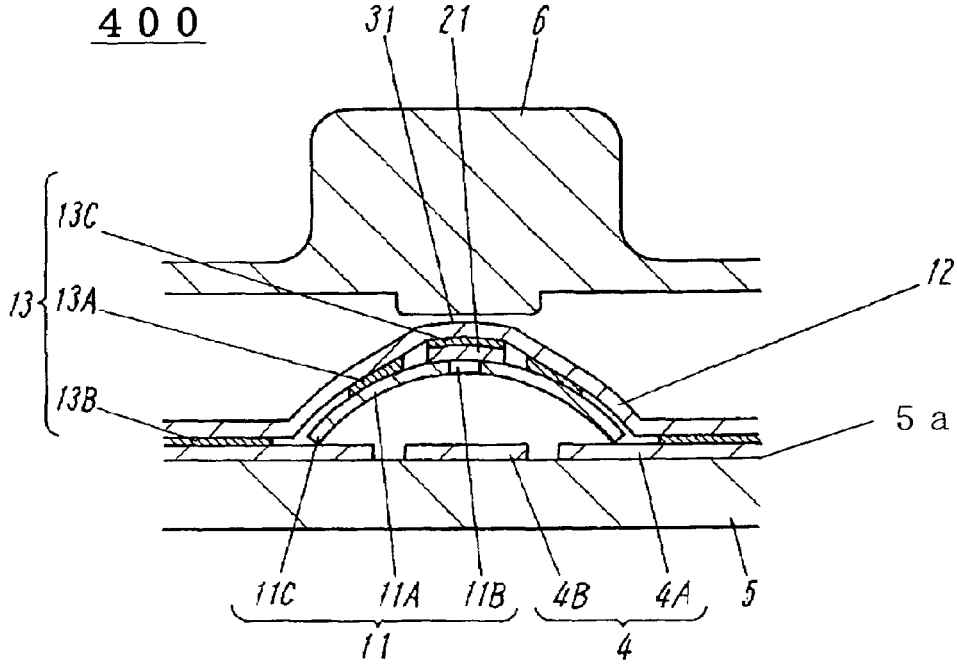
FIG. 4 is a cross sectional view of a panel switch using the movable contact element of the embodiment of the present invention.
Figure 5:
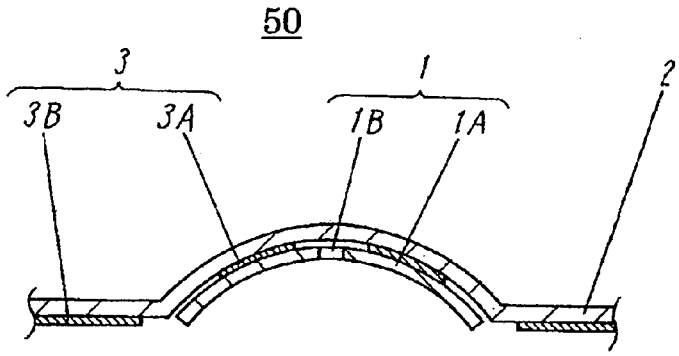
Fig.5 (PRIOR ART)
FIG. 5 is a cross sectional view of a conventional movable contact element.
Figure 6:
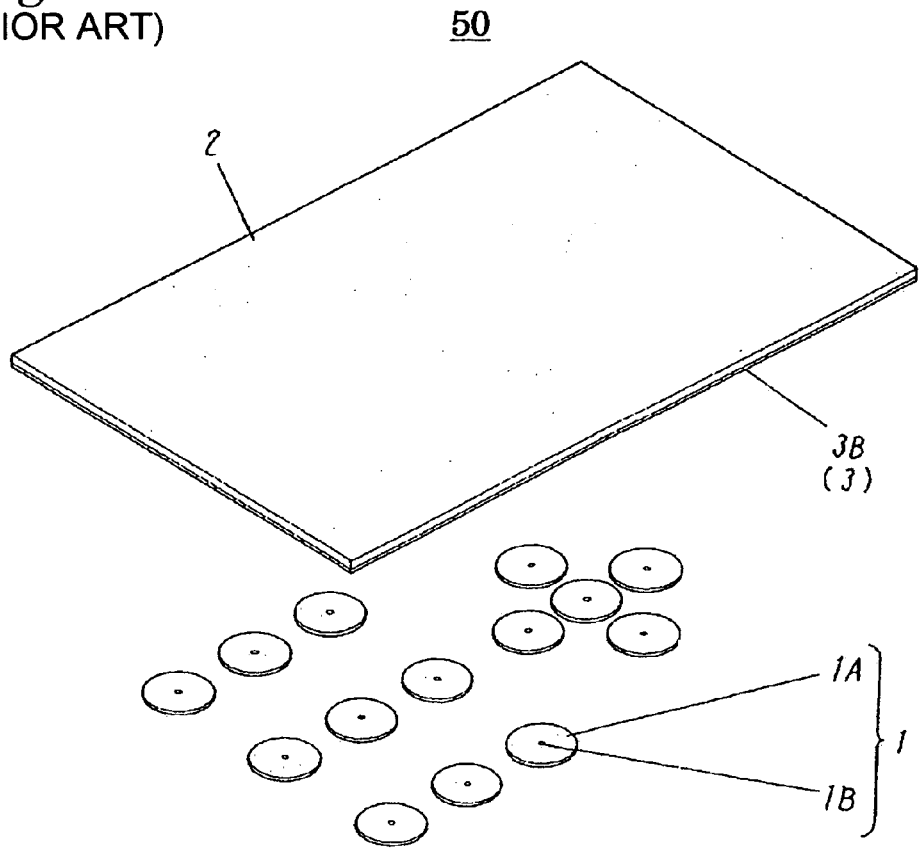
Fig.6 (PRIOR ART)
FIG. 6 is an exploded perspective view of the conventional movable contact element.
Figure 7:
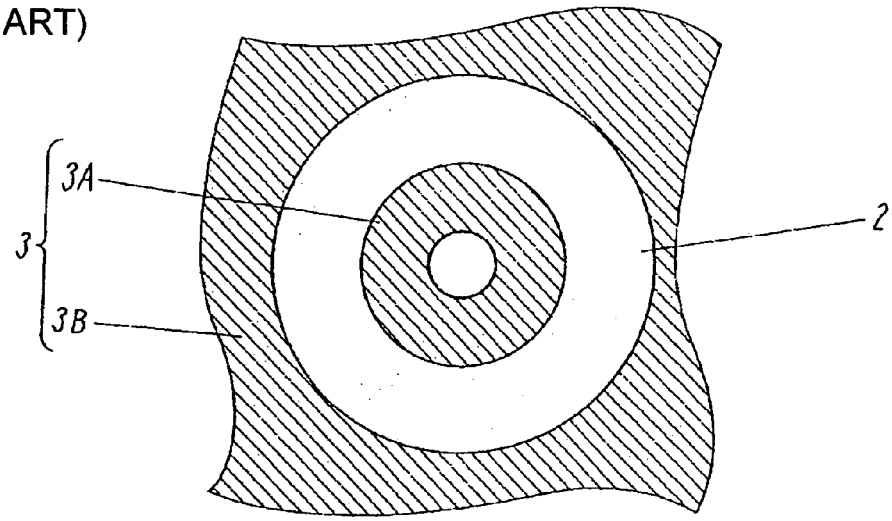
Fig.7 (PRIOR ART)
FIG. 7 is an enlarged view showing application of adhesive to the area of a base sheet that corresponds to a movable contact point, which is a main part of the conventional movable contact element.
Figure 8:
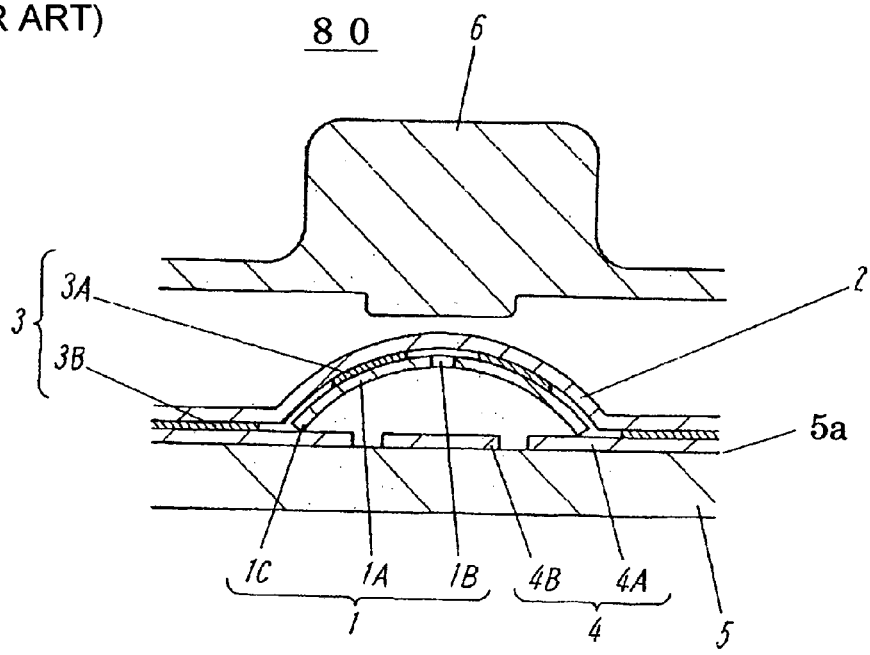
Fig.8 (PRIOR ART)
FIG. 8 is a cross sectional view of a panel switch using the conventional movable contact element.
Figure 9:
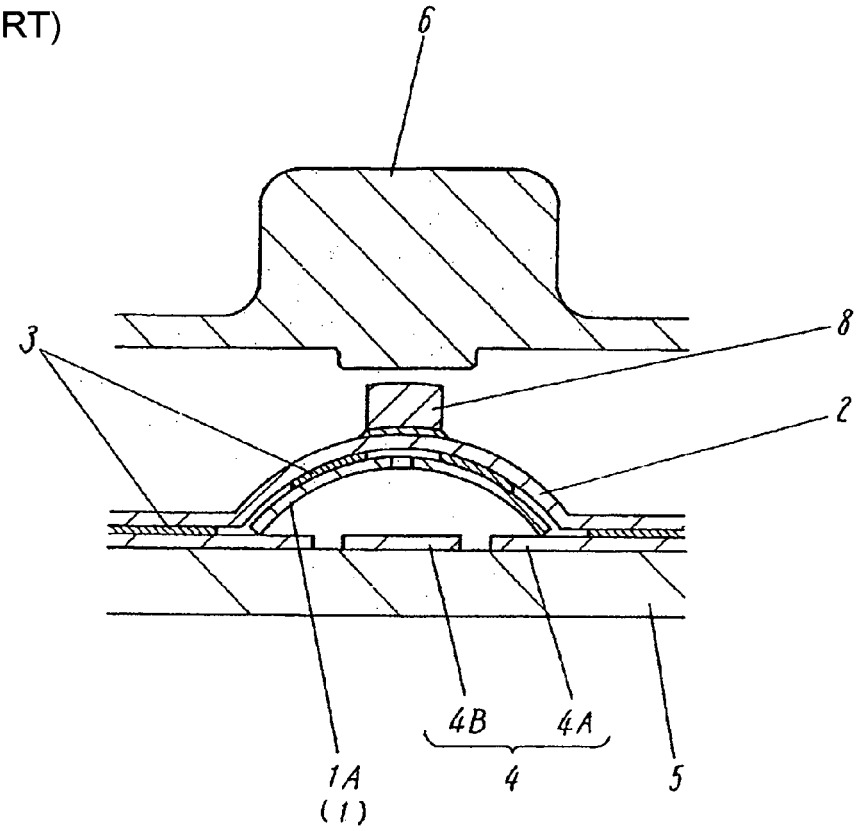
Fig.9 (PRIOR ART)
FIG. 9 is a cross sectional view of a panel switch using another conventional movable contact element.

FIG. 4 is a cross sectional view of a panel switch using the movable contact element of the present invention. Panel switch 400 shown in FIG. 4 has movable contact element 100 shown in FIG. 1 including movable contact point 11, base sheet 12 and adhesive 13. Movable contact point 11 includes domed part 11A, throughhole 11B and circumferential bottom edge 11C. Adhesive 13 is applied in the shapes of circular ring part 13A, peripheral part 13B and small-diameter circular part 13C.

Each spacer piece 21 is shaped into a pillar by, for example, punching an insulating film such as PET, and is placed in the center of the outer surface of domed part 11A. The top surface of spacer piece 21 is fixedly bonded to base sheet 12 by small-diameter circular part 13C of adhesive 13. Spacer piece 21 should have an area not smaller than throughhole 11B in order to cover throughhole 11B completely. The bottom surface of spacer piece 21 and the outer surface of domed part 11A of movable contact point 11 are merely stacked each other without being fixedly bonded to each other.

Spacer piece 21 is disposed between the center of the bottom surface of base sheet 12 and the center of the outer surface of domed part 11A. As a result, the center of base sheet 12 is swollen upward to form a small protrusion, which is as high as the thickness of spacer piece 21. The small protrusion serves as pressed part 31 of movable contact point 11.

FIG. 4 is a cross sectional view of the panel switch using the movable contact element of the present invention. As shown in FIG. 4, fixed contact point 4 having a pair of outer fixed contact point 4A and central fixed contact point 4B is placed at the position on one main surface 5*a* of wiring board 5 that corresponds to movable contact point 11 of movable contact element 100.

Outer fixed contact point 4A is fixedly bonded to the bottom surface of base sheet 12 by peripheral part 13B of adhesive 13 so as to vertically align throughhole 11B formed in the center of domed part 11A with the center of central fixed contact point 4B.

The movable contact element of the present invention is thus structured. In order to use it as a panel switch, as shown in FIG. 4, movable contact point 11 is aligned with the corresponding fixed contact point 4 (4A,4B) formed on one main surface 5*a* of wiring board 5, and is fixedly bonded at its outer surface to the bottom surface of base sheet 12 by peripheral part 13B of adhesive 13 applied on the bottom surface of base sheet 12. In this condition, each single switch is formed in such a manner that circumferential bottom edge 11C of movable contact point 11 is placed on the corresponding outer fixed contact point 4A, and the inner surface of domed part 11A is opposed to the corresponding central fixed contact point 4B with a predetermined spacing. Above each movable contact point 11 is disposed manual operation button 6 for allowing the user to press the single switch.

Just like the aforementioned conventional movable contact element, the movable contact element of the present invention is also provided with a protection sheet made of an insulating film which covers at least the entire bottom surface of base sheet 12 in order to protect movable contact points 11 and adhesives 13 from dust and the like during transportation and storage. The protection sheet is removed before base sheet 12 is bonded to one main surface 5*a* of wiring board 5.

When a single switch in the panel switch is activated, the user presses manual operation button 6 of the electronic device to make the bottom surface of manual operation button 6 come into contact with the small protrusion of pressed part 31. Along with the pressure of the user to press manual operation button 6 downward, movable contact point 11 is pressed downward.

Even if there is a slight misalignment between the center of movable contact point 11 and the center of manual operation button 6 due to variations in assembly, the structure of the present invention makes pressed part 31 transmit the pressing force applied on manual operation button 6 onto the center of movable contact point 11.

When the pressing force exceeds a prescribed level, domed part 11A of movable contact point 11 is turned upside down with a sense of moderation, and the inner surface of domed part 11A comes into contact with the corresponding central fixed contact point 4B. As a result, the switch becomes the ON state in which outer fixed contact point 4A and central fixed contact point 4B become electrically continuous with each other via movable contact point 11.

When the user release the pressing force to manual operation button 6, the inner surface of domed part 11A leaves central fixed contact point 4B so as to restore domed part 11A to the original convex shape with a sense of moderation, thereby pushing back manual operation button 6 upward. As a result, the switch returns to the OFF state as shown in FIG. 4 in which outer fixed contact point 4A and central fixed contact point 4B are electrically isolated from each other.

In order to reduce the direct effect of spacer piece 21 on movable contact point 11 in operation, it is preferable that spacer piece 21 and movable contact point 11 are not fixedly bonded to each other. Not fixedly bonding to each other allows air to be moved in and out of movable contact point 11 via throughhole 11B while movable contact point 11 is in operation. This prevents the operation feeling from being degraded due to air compression or the like.

As described hereinbefore, the movable contact element and panel switch using it of the present invention ensures the pressing of the center of movable contact point 11 by the provision of pressed part 31, even if there is a slight misalignment between manual operation button 6 and movable contact point 11 during production or integration process. As a result, the user can be provided with excellent operation feeling.

Pressed part 31 can be formed of the small protrusion of base sheet 12 swollen upward, i.e., toward manual operation button 6 as a result of the provision of spacer piece 21 between the bottom surface of base sheet 12 and the outer surface of domed part 11A. This structure can eliminate the detachment of spacer piece 21 from base sheet 12 after repeated operation, and can also simplify the production and integration processes of the movable contact element. As a result, the panel switch can provide the user with excellent operation feeling for a long time.

The technical idea of the present invention is not limited to the aforementioned structure. For example, the movable contact point does not have to have a throughhole. Furthermore, the movable contact point and the spacer piece can be fixedly bonded to each other. The spacer piece can be simply sandwiched without fixedly bonding either of its top and bottom surfaces.

According to the movable contact element and the panel switch using it of the present invention, the portion of the base sheet having the spacer piece thereunder is swollen upward, i.e., toward the manual operation button, so that the small protrusion can serve as the pressed part of the movable contact point. This can simplify the production and integration processes of the panel switch, and maintain excellent operation feeling for a long time. The movable contact element and the panel switch using it of the present invention, which are useful to a panel switch on the operation panel of various electronic devices, provide high industrial applicability.

What is claimed is:

1. A movable contact element comprising:

a base sheet made of an insulating film and having adhesive on a bottom surface thereof;

a movable contact point made of an elastic metal plate and having a domed part with an open bottom, an outer surface of the domed part being fixedly bonded to the bottom surface of the base sheet by the adhesive; and a spacer piece placed on a center of the outer surface of the domed part of the movable contact point in such a manner that the spacer piece is sandwiched between the bottom surface of the base sheet and the center of the outer surface of the domed part, wherein a portion of the base sheet having the spacer piece thereunder forms a small protrusion, and the small protrusion serves as a pressed part of the movable contact point.

2. The movable contact element of claim 1, wherein the movable contact point has a throughhole in the center of the domed part; and the spacer piece has a top surface fixedly bonded to the bottom surface of the base sheet by the adhesive applied on the bottom surface of the base sheet, and also has a bottom surface placed on the outer surface of the domed part.

3. A panel switch comprising:

the movable contact element of claim 1;

a wiring board; and a fixed contact point having a pair of an outer fixed contact point and a central fixed contact point, the fixed contact point being formed on a top surface of the wiring board, wherein the movable contact element is fixedly bonded to the wiring board by the adhesive applied on the bottom surface of the base sheet in such a manner that a circumferential bottom edge of the movable contact point of the movable contact element is placed on the outer fixed contact point.

* * * * *